US006213355B1

(12) United States Patent
Schwanenberg

(10) Patent No.: US 6,213,355 B1
(45) Date of Patent: Apr. 10, 2001

(54) CLOSURE MEMBRANE AND CLOSURE EMPLOYING SAME

(75) Inventor: Sigurd Schwanenberg, Lucerne (CH)

(73) Assignee: Zeller Plastik GmbH, Zell/Mosel (DE)

( * ) Notice: Subject to any disclaimer, the term of this patent is extended or adjusted under 35 U.S.C. 154(b) by 0 days.

(21) Appl. No.: 09/194,547

(22) PCT Filed: May 28, 1997

(86) PCT No.: PCT/EP97/02788

§ 371 Date: Jun. 9, 1999

§ 102(e) Date: Jun. 9, 1999

(87) PCT Pub. No.: WO97/45329

PCT Pub. Date: Dec. 4, 1997

(30) Foreign Application Priority Data

May 30, 1996 (DE) ..... 196 21 676

(51) Int. Cl.[7] ..... B65D 25/40

(52) U.S. Cl. ..... 222/494; 222/212

(58) Field of Search ..... 222/494, 212, 222/541.4, 541.3, 481.5, 490

(56) References Cited

U.S. PATENT DOCUMENTS

| | | | | |
|---|---|---|---|---|
| 2,061,124 | | 11/1936 | Walther | 221/60 |
| 2,175,052 | | 10/1939 | Bull et al. | 221/60 |
| 4,349,134 | | 9/1982 | Schuster et al. | 222/212 |
| 4,579,974 | | 4/1986 | Cheminal et al. | 568/394 |
| 4,830,205 | | 5/1989 | Hammond et al. | 222/541.6 |
| 4,991,745 | | 2/1991 | Brown | 222/212 |
| 5,213,236 | | 5/1993 | Brown et al. | 222/185 |
| 5,409,144 | | 4/1995 | Brown | 222/494 |
| 5,439,143 | * | 8/1995 | Brown et al. | 222/494 |
| 5,531,363 | | 7/1996 | Gross et al. | 222/494 |
| 5,632,420 | | 5/1997 | Lohrman et al. | 222/490 |
| 6,095,381 | * | 8/2000 | Schwanenberg | 222/494 |
| 6,112,951 | * | 9/2000 | Mueller | 222/490 |

FOREIGN PATENT DOCUMENTS

| | | |
|---|---|---|
| 830 478 | 2/1952 | (DE) . |
| 1486403 | 5/1969 | (DE) . |
| 2 304 274 | 8/1973 | (DE) . |
| 26 09 310 | 9/1976 | (DE) . |
| 19 510007 | 10/1995 | (DE) . |
| 19613130 | 3/1997 | (DE) . |
| 046 464 B1 | 3/1982 | (EP) . |
| 146 464 | 11/1986 | (EP) . |
| 442 379 A2 | 8/1991 | (EP) . |
| 442 379 A3 | 8/1991 | (EP) . |
| 545 678 A2 | 6/1993 | (EP) . |
| 616 957 | 2/1949 | (GB) . |
| 625 610 | 8/1949 | (GB) . |
| 8-282703 | 10/1996 | (JP) . |
| 96912 | 10/1960 | (NO) . |
| WO 94/00363 | 1/1994 | (WO) . |
| WO 94/05425 | 3/1994 | (WO) . |
| WO 94/26612 | 11/1994 | (WO) . |
| WO 95/21098 | 8/1995 | (WO) . |
| WO 95 26306 | 10/1995 | (WO) . |
| WO 95 34500 | 12/1995 | (WO) . |
| WO 97/09245 | 3/1997 | (WO) . |
| WO 97/30905 | 8/1997 | (WO) . |

* cited by examiner

*Primary Examiner*—Philippe Derakshani
(74) *Attorney, Agent, or Firm*—Woodcock Washburn Kurtz Mackiewicz & Norris LLP

(57) ABSTRACT

The invention relates to a closure membrane (2) with a closure head (5) and a retaining border (3), the closure head being connected to the retaining border via a connecting wall adjoining the outer border, with the entire arrangement being of essentially cup-shaped design, the closure head preferably being of a thickness which increases outwards from the center. The connecting wall is attached to the closure head via a connecting web (51) which is of lesser thickness than the border region of the closure head and which in the rest position of the membrane projects radially inwards from the connecting wall.

34 Claims, 11 Drawing Sheets

CLOSURE MEMBRANE AND CLOSURE EMPLOYING SAME

The invention relates to a closure membrane with a closure head and a retaining border, the closure head being connected to the retaining border via a connecting wall adjoining the outer border, with the entire arrangement being of essentially cup-shaped design, and, furthermore, the closure head preferably being of a thickness which increases outwards from the centre.

Such closure membranes have already been disclosed in a large number of configurations. You are referred, for example, to EP-A-545 678, also to EP-B-046,464, EP-A-442 379 and U.S. Pat. No. 2,175,052 and, additionally, to German Patent Application 19613130.8, which is not a prior publication. The disclosure of the last-mentioned patent application is included in full in the disclosure of the present application, also for the purpose of incorporating features of said patent application in claims of the present application.

Such a closure membrane is not yet regarded as optimum in all respects as far as its closure behaviour is concerned. This is also put down to the fact that, in particular depending on the specific installation conditions, forces acting on the connecting wall have an undesirable effect on the closure head.

Taking said prior art as a basis, the invention is concerned with the technical problem of specifying an improved closure membrane.

This technical problem is solved first and foremost with the subject matter of claim 1, this being based on the fact that the connecting wall is attached to the closure head via a connecting web, which projects radially inwards from the connecting wall and is of a lesser thickness than the border region of the closure head. According to the invention, the region where the closure head is connected to the connecting wall tapers, in cross-section, with respect to the (border-side) thickness of the closure head. Nevertheless, the resulting radially inwardly projecting connecting web is closed all the way round, this further maintaining the closed state of the closure membrane. It has advantageously been shown that, as a result, the movement of the closure head is largely isolated from the movements and the forces to which the connecting wall is subjected or which act on the connecting wall.

The connecting web acts as a hinge, with little or no flexural rigidity. Preferably the thickness range is 0.2 mm to 0.35 mm, especially 0.25 mm. The connecting wall is preferably at least 50% thicker than the connecting web. A preferred thickness range is 0.3 mm to 0.6 mm, especially 0.4 mm. This construction has the advantage that hinging occurs preferentially at the connecting web. It further allows easy moulding of the closure membrane. In a further configuration, it is also provided that the connecting web adjoins the closure head approximately centrally, as seen in the vertical direction. The connecting web may advantageously adjoin the closure head eccentrically, as seen in the vertical direction. It is also possible for the connecting wall to extend beyond the connecting web such that a peripheral groove is formed with the border edge of the closure head. This may also be advantageous as regards supporting the border edge on a top closure part or a hinge mechanism of the closure head. It is also advantageous if the connecting wall and the connecting web are connected to the closure head so as to produce, in cross-section, two mutually opposite, peripheral grooves, between the connecting wall and the closure head, which are separated by the connecting web. In a further detail, it may also be provided, in relation to a closure into which such a closure membrane is inserted, that, in the non-actuated installed state, the closure membrane has a bottom retaining border and a top, essentially concave closure head, the closure head and the retaining border, furthermore, being connected to one another by said connecting wall. It is also preferred for the installed state of the closure membrane to be achieved by turning the closure membrane inside out after it has been produced by injection moulding. This produces favourable force effects. In particular, on the one hand, the concave closure head is advantageously prestressed into its closed state by radially acting forces of the inside-out connecting wall. On the other hand, however, rapid opening, in particular for ventilating purposes, during sucking back, should also be noted. Furthermore, starting from a border-side attachment to the closure head, the connecting wall may preferably continue into a constriction beneath a projection area of the closure head, this observation once again being based on the installed state. As is explained in more detail below, this is achieved, in particular, in that, in the production state (injection-moulded state), the connecting wall extends essentially cylindrically, starting from the closure head. Depending on the desired properties of the closure membrane, however, there may also be a variation here in terms of a conical configuration. Continuation into a constriction beneath the projection area of the closure head produces something of a goblet-like configuration of the closure membrane as a whole in this region. Furthermore, there are also applications in which, even in the installed state, the connecting wall adjoins the bottom of the closure head in an essentially cylindrically extending manner, in particular when the abovementioned operation of turning the closure membrane inside out after production is not carried out. Specifically, it is advantageous, in particular with respect to the above-described inside-out, installed state, if, as has already been mentioned, the border side of the closure head is of a greater thickness than the boundary wall. The abovedescribed connecting web, in particular, also has an advantageous effect here. The closure head may taper inwards continuously, starting from its border region. The boundary wall is attached to a top region of the border edge, as seen in cross-section, of the closure head of the closure membrane this observation once again being based on the installed state—and the boundary wall grips over a bottom, free border region of the boundary edge of the closure head. As a result of the abovedescribed, advantageously set compressive forces directed towards a centre point of the closure head, this being achieved by a certain enforced widening of the elastic material of the closure membrane, in particular of the connecting wall, a radially inwardly directed force is thus exerted on the border edge of the closure head, essentially over the entire circumference. These forces are also absorbed extremely favourably as a result of the closure head extending in a dome-shaped manner. At the same time, as a result of the abovedescribed attachment via a connecting web, a little-desired moment is transmitted to the closure head only to a slight extent, if at all. As a result of the prevailing radial forces and the resulting prestressing in the closure membrane and, in particular, in the closure head of the closure membrane, further advantageous properties are achieved during actuation of the closure membrane. The resulting prestressing in the dome-shaped structure of the closure membrane, on the one hand, ensures a high sealing force and, on the other hand, when the dome-shaped structure is disrupted (dispensing operation or sucking back), breaking out also takes place straight away in response to relatively low force exertion. In a conventional dispensing operation, the radial opening slits preferably provided in the closure head open, above a certain pressure, reliably and almost abruptly. As a dispensing operation is completed, and the squeezable bottle on which the closure, for example, is fitted returns into its original position, first of all the closure head is drawn into the initial, concave state, in a conventional manner, and then it opens out downwards with sucking back of air, which, despite the abovedescribed stressing prevailing in the closure head, does not require a great amount of force or negative pressure, but rather only a relatively small amount thereof. In a further advantageous configuration, it is also provided that, in the injection-moulded state, the connecting wall runs essentially cylindrically. However, as has already been mentioned, the abovedescribed prestressing to which the closure head is subjected in the inside-out state of the closure membrane, or a funnel formation, may also be influenced and varied by a change in the angle in the connecting wall (as seen in cross-section). The connecting wall merges into a peripheral reinforcement region, and a fastening ring is attached to the reinforcement ring. The reinforcement ring has proven to be advantageous, in particular, with respect to the closure membrane moving out telescopically in the event of pressure build-up, as is described in more detail below. The fastening ring serves for retaining the closure membrane in the closure. In a further preferred detail, it is provided that the fastening ring is connected to the reinforcement ring via an attachment wall which, in cross-section, extends at an angle to the connecting wall.

In relation to the closure, it is also particularly preferred for a widened region to adjoin the through-passage opening, formed in the closure cap, towards the outside, and for the closure head of the closure membrane to be assigned to this widened region. For passing through the through-passage opening (as seen from the bottom upwards), the connecting wall can extend into the widened region. It is not absolutely necessary here for the connecting wall to rest against the widened region in the rest state of the closure. However, the connecting wall usually comes to butt against the widened region during a dispensing operation, this being accompanied by advantageous force conditions, which are described in more detail below, and by the opening operation in the closure head being influenced, usually assisted. Arranging the closure head, according to the invention, in the widened region results, first of all, in the closure head having a certain amount of support in the downwards direction, but, if appropriate, also in the radially lateral direction. In addition, the taper provided beneath the closure head by the widened region and the through-passage opening is advantageous in that it provides something of a positively locking seat for the closure membrane. Simple installation of the closure membrane is possible. Adhesive bonding or the like is not necessary. Nevertheless, the closure head has sufficient freedom of movement in order to carry out a discharge operation in an advantageous manner. The closure head itself may be comparatively thin. Nevertheless, the concave configuration and the radially inwardly acting support in the widened region produce a comparatively high closure force, which reliably makes it possible to achieve full closure of the discharge opening. This influencing or assisting of the closure force, and thus also of the opening characteristics of the closure membrane, may be provided on its own or in combination with the abovedescribed influencing which can be achieved by turning the closure membrane inside out. Specifically, the closure head may be designed with slits which, starting from a centre point, extend in the radial direction. In the rest state of the closure membrane, the slits are fully closed as a result of the slit-bounding sides pressing against one another. Upon actuation of the container on which such a closure is fitted, the closure head is forced outwards and opening is achieved by the slits gaping open. In combination with this, or as an alternative, it may be provided that the closure head has a permanent, central opening, a supporting plate, on which the closure head is seated in a sealing manner in the rest state, being formed beneath the opening, with the result that, in this embodiment too, full closure is achieved in the rest state. In a further detail, as regards said supporting plate, you are also referred to German Patent Application 19 51 007, which is not a prior publication, and the international Patent Application PCT/EP95/01104. The disclosure of these earlier applications is included in the disclosure of the present application, also for the purpose of incorporating them in claims of the present application. In a further configuration, it is provided that a border bead, which projects beyond the closure head, is formed in an outer region of the closure head. Such a border bead, which nevertheless does not project beyond the through-passage opening in the rest state, is known it its own right, in a comparable closure membrane from EP-A2 545 678, which was mentioned in the introduction. In the context of the present invention, however, it is provided that the border bead is arranged in the area of the widened region, and thus outside the through-passage opening. Since the border bead is arranged in the area of the widened region, this means, at the same time, that this bead is turned outwards, and thus is exposed at the top. In addition, the bead is given support in the downward direction and radial support. This may be utilized, for the purposes of transportation safeguard, to provide a closure head or the like which acts on the border bead. Securing of the border bead not only obstructs an opening movement of the closure head to a certain extent, but also achieves, in particular, as a result of the flexibility of the material of the closure membrane, advantageous sealing in the transporting state. In addition, the sealing action is further enhanced by an increased internal pressure which may possibly arise during transportation if the container is subjected to corresponding pressure. It is also proposed that a—further—widened region, which opens in the opposite direction, directly adjoins the through-passage opening, beneath the latter. One or both of the abovementioned widened regions may be of essentially conical design. Overall, this produces something of a double rivet-like design of the inserted closure membrane and correspondingly advantageous retention of the closure membrane in the closure cap. In a further-preferred configuration, it is provided that a groove-like depression which reaches as far as the through-passage opening is formed in the widened region which adjoins the through-passage opening towards the outside. Specifically, the depression is preferably formed vertically and/or radially. This permits advantageous ventilation, for the sucking back of air into the container after a discharge operation. In this case, the air flows through a channel which is formed by the widened region and the through-passage opening and is covered by the connecting wall. It is also possible for corresponding air openings to be formed, as bores or channels, just in the wall of the widened region and of the through-passage opening. The air which has been newly sucked back results in a lifting action in the region of the border bead.

The invention is explained in more detail hereinbelow with reference to the attached drawing, which nevertheless merely illustrates some exemplary embodiments, in which.

Figure 1:
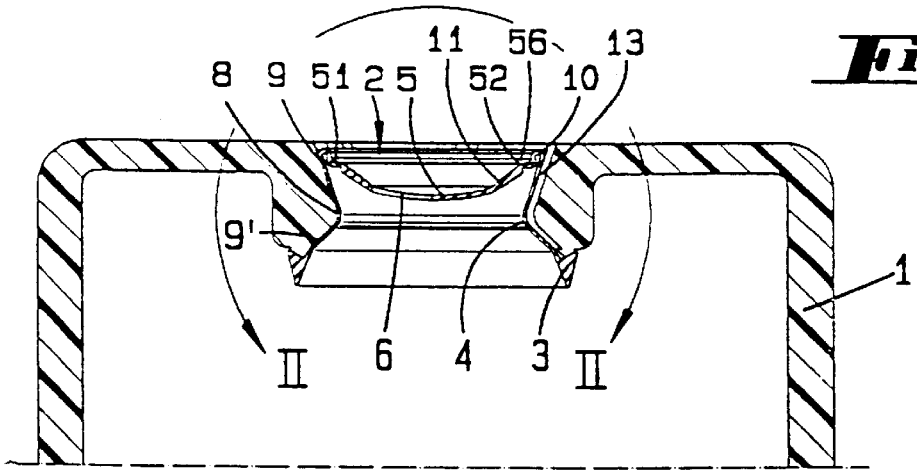
FIG. 1 shows a cross-section through a closure cap with a closure membrane in a first embodiment, the section being taken along line I—I in FIG. 3.
Figure 2:
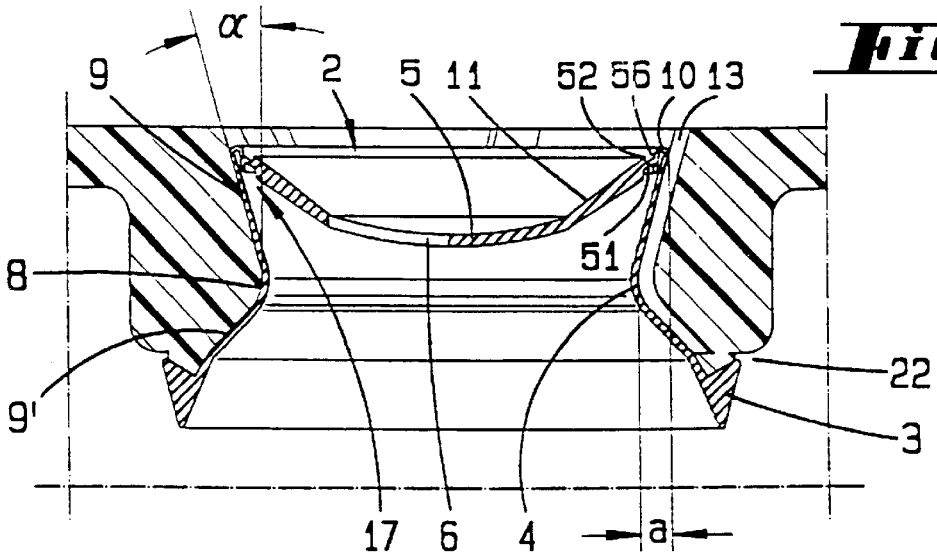
FIG. 2 shows an enlarged illustration of the closure according to FIG. 1.

The illustrations and description relate, first of all with reference to FIG. 1, to a self-closing closure with a closure cap 1 and a closure membrane 2, only part of the closure cap 1 being illustrated. Furthermore, the closure cap 1 is part of a container which can be compressed in order to discharge fluid contents—this not being illustrated specifically.

The closure membrane 2 has a bottom, peripheral retaining border 3, a connecting wall 4, which essentially extends upwards from the retaining border 3, and a top closure head 5. Slits 6, 7 which extend radially from a centre point are formed in the closure head 5 (see also FIG. 3).

Figure 10:
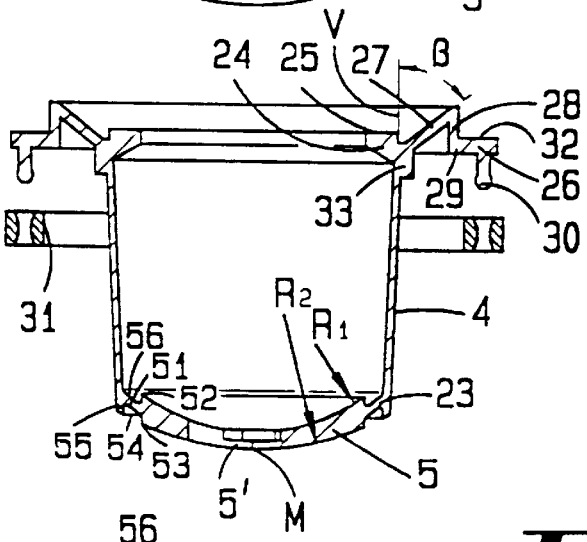
FIG. 10 shows a section through the closure membrane according to FIG. 9, the section being taken along line X—X in FIG. 9, with an associated installation ring which is illustrated in cross-section.
Figure 13:
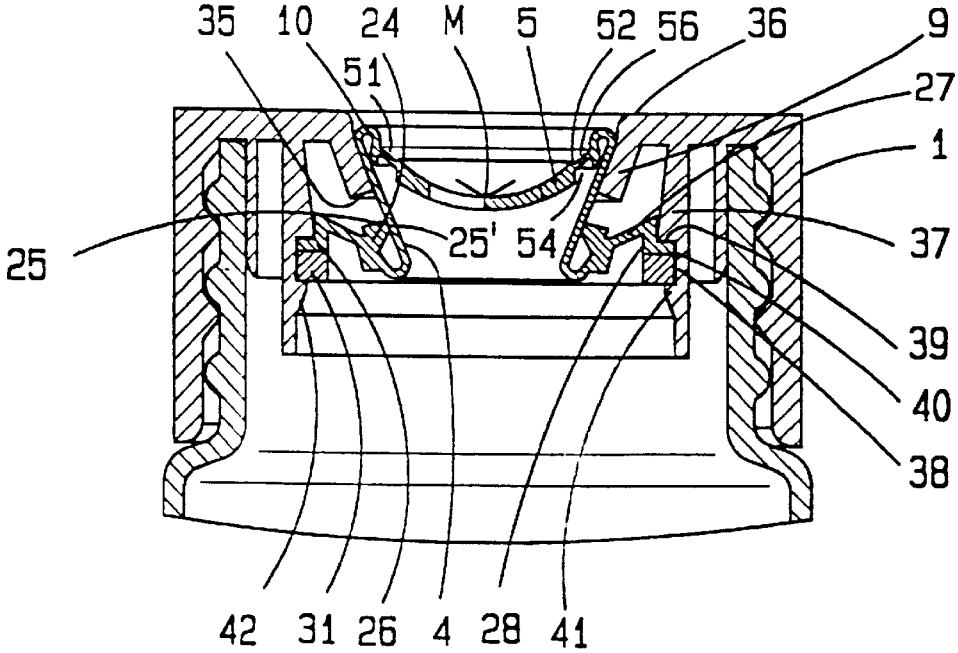
FIG. 13 shows an illustration of the subject matter of FIGS. 9 to 12 installed in a closure, in the non-actuated state.
Figure 14:
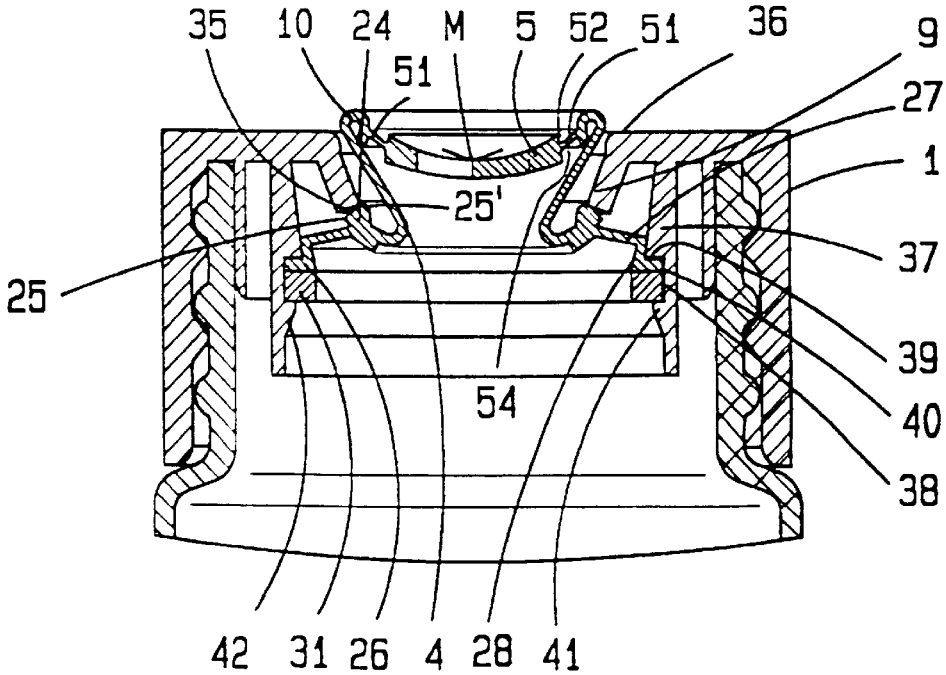
FIG. 14 shows an illustration according to FIG. 13, after an increase in the internal pressure in the container provided with the closure, but before commencement of a dispensing operation.
Figure 15:
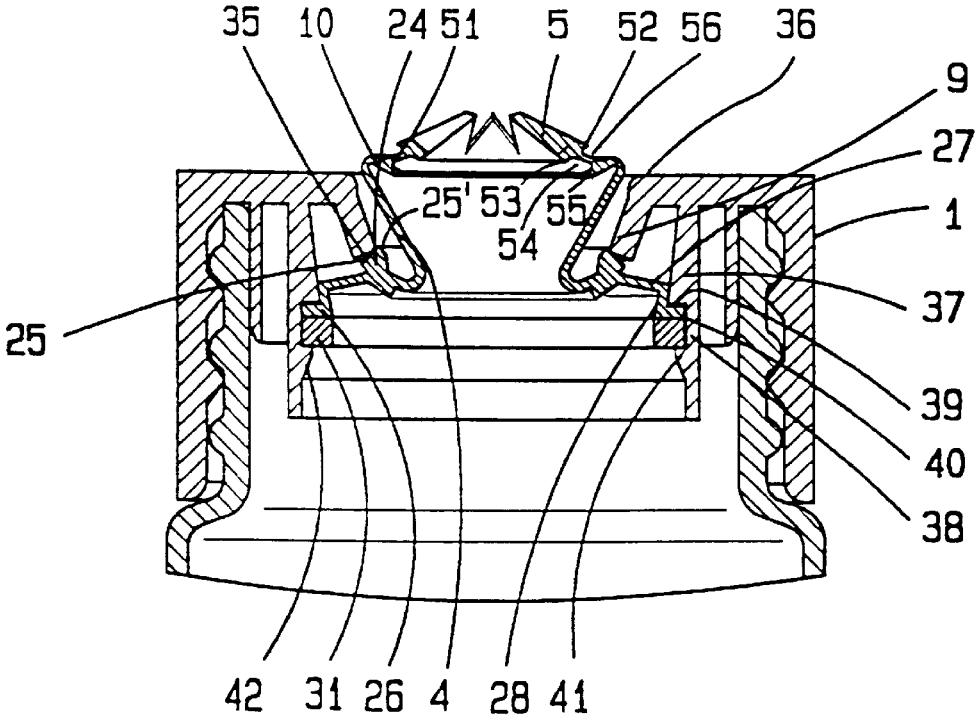
FIG. 15 shows the closure according to FIG. 13 in the dispensing state.

The essential factor is, and you are referred, in particular, to FIG. 10 for this, that the connecting wall 4 is attached to the closure head 5 via a connecting web 51, which projects radially inwards from the connecting wall 4. The connecting web 51 is of a lesser thickness than the closure head 5 (in the border region of the latter). The connecting web 51 is attached to the closure head beneath a top border surface 52 of the closure head 5, i.e. forming a step, and above a bottom surface 53 of the closure head 5, likewise forming a step here. As can also be seen, in particular, from the other illustrations, the connecting web 51 is thus attached to the closure head 5 eccentrically, as seen in the vertical direction. In the exemplary embodiment, the thickness of the connecting wall 4 corresponds approximately to the thickness of the connecting web 51. Overall, the connecting web 51 provides the end structure, formed in this region, of the connecting wall 4 and the border side of the closure head 5 with an essentially H-structure (as seen in cross-section). The amount by which the connecting web 51 juts back from the upper side 52 of the closure head 5 corresponds approximately to the thickness of the connecting web 51. As can be seen, the connecting wall 4 extends beyond the connecting web 51 in this region, a peripheral groove 54 being formed in the process between a border edge of the closure head 5 (which forms the surface 53) and a flange or sub-region 55, which projects downwards beyond the connecting web 51, of the connecting wall 4. The sub-region 55 of the connecting wall 4 projects beyond the connecting web 51 approximately by such an extent that an imaginary continuation of the surface 53 of the closure head 5 would produce an essentially stepless transition into the sub-region 55. It can also be seen that, specifically, two grooves 54, 56 are produced. The groove 56 is formed in the same manner in the upper region of the closure head 5. However, the groove 56 is bounded as a result by the downwardly continuing connecting wall 4 (see, for example, FIGS. 13, 14). In any case, however, in the inside-out state, an only slightly projecting border region of this groove 56 results from the bead of the connecting wall 4 which is formed there. It is clear, in particular, that, as a result of the connecting web 51, forces are only transmitted to a slight extent from the bead formation of the connecting wall 4 to the closure head 5.

It can further be seen, with reference to FIGS. 1–8, that the closure cap 1 forms a through-passage opening 8, which widens outwards in the form of a widened region 9. The through-passage opening 8 can be seen in the narrowest region of the discharge opening as a whole. The connecting wall 4 passes through the through-passage opening 8 and, during actuation at any rate, is supported radially in the widened region 9.

Furthermore, the connecting wall 4 merges, via an attachment curve, which forms a top, peripheral border bead 10, into the connecting web 51 and, further on, the closure head 5.

The connecting web 51 is not illustrated specifically in FIGS. 4 to 8. The size of the closure membrane 2 prevents it from being depicted here in a suitable manner. However, the conditions are the same as for the closure membrane in FIGS. 1 and 2.

The closure head 5 is of a greater thickness than the connecting wall 4, for example two to four times the thickness of the latter in the exemplary embodiment. The thickness varies since the closure head 5 tapers towards its centre. Furthermore, bevels 11 are formed radially on the outside of the inner surface of said closure head.

The widened region 9 is of conical configuration. A cone angle alpha is approximately 15 to 40°. A cone value of approximately 25° is preferred.

Figure 20:
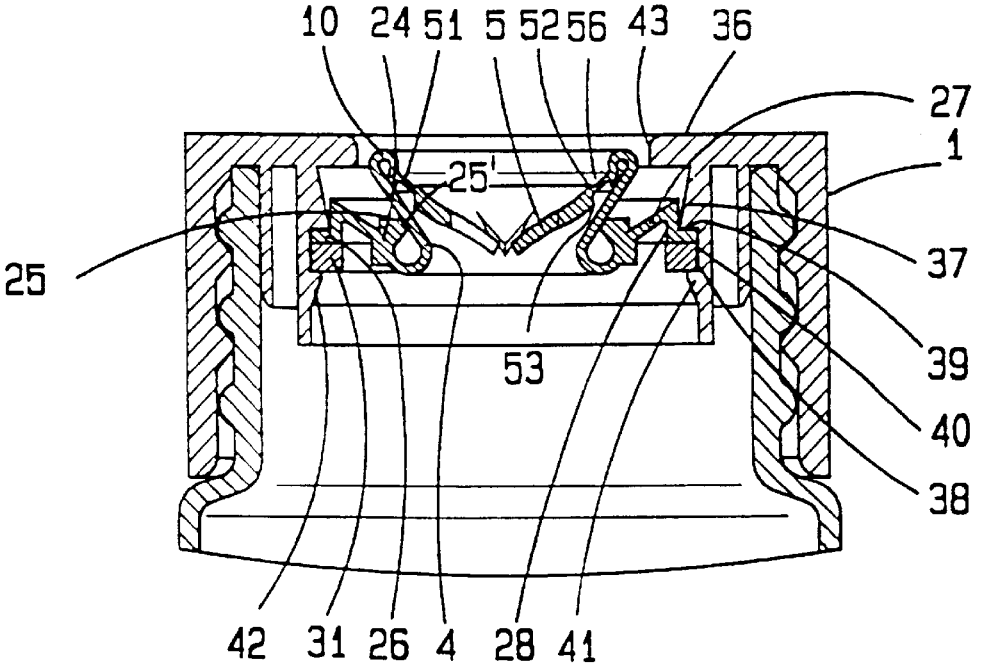
Figure 21:
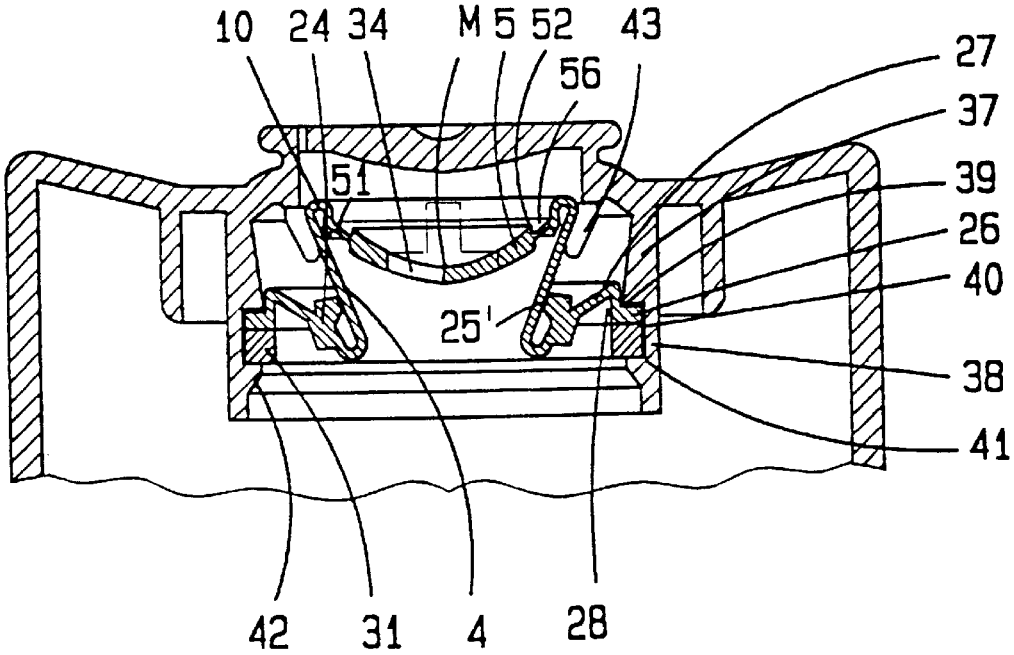
FIGS. 21 to 23 show illustrations corresponding to FIGS. 13 to 16, but for a third installation example.
Figure 22:
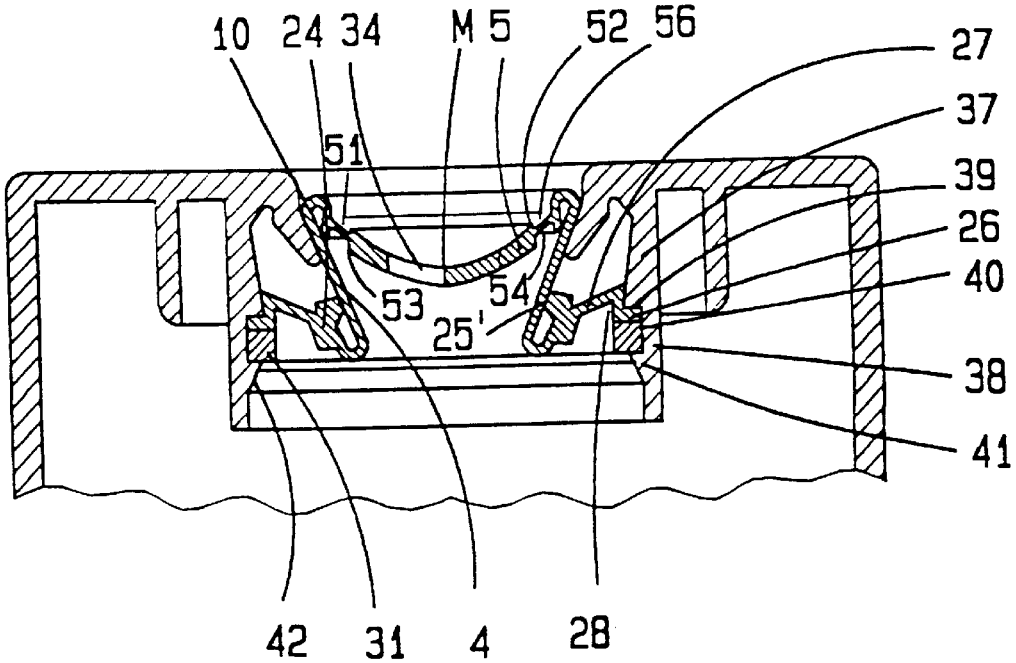
Figure 23:
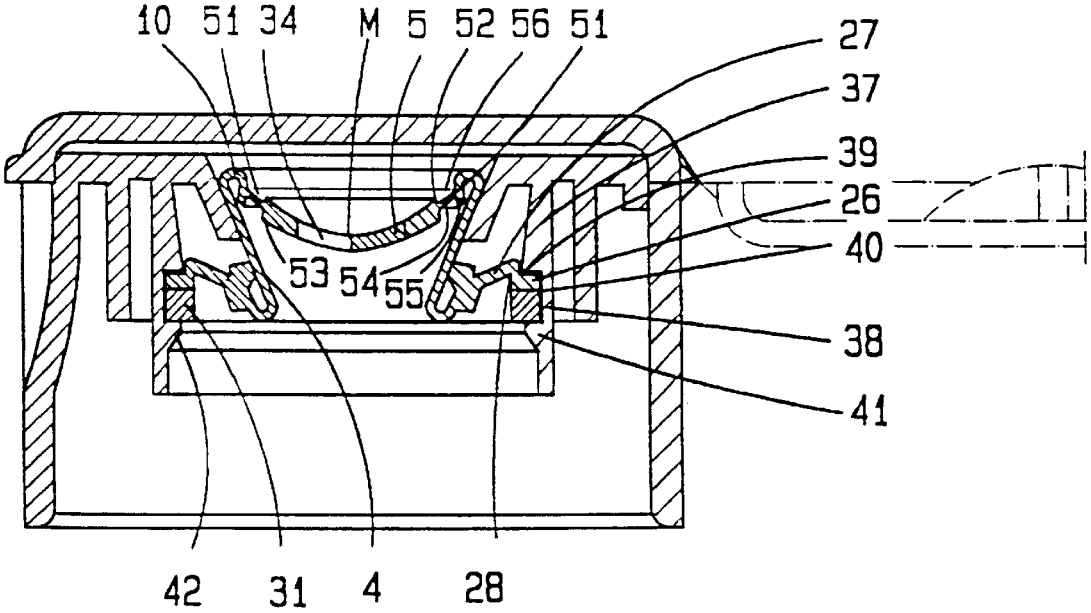

FIGS. 1 to 3 and 5 to 8 illustrate the non-actuated state in each case. In the actuated state according to FIG. 4, for example the action of squeezing the container on which the closure cap 1 is fitted (which is not illustrated any more specifically) causes the product to be placed under pressure and thus to press against the inner surface of the closure head 5. The closure head 5 breaks open, with a simultaneous reduction in the cone pressure and in the pressure which the closure membrane 2 exerts radially on the cone surface 9 and with a neutralization of the prestressing, as it were, in the centre, and segment-like tabs of the closure membrane are caused to gape open, this resulting in a dispensing opening 12. This behaviour is basically the same for all the exemplary embodiments illustrated. As the pressure on the container decreases, the closure head of the closure membrane closes and is drawn downwards, or is drawn back. The sub-region 55 comes in contact with the inner surface of the connecting wall 4. This prevents the closure head being sucked inside during venting. This is particularly useful for connecting walls 4 which are conical rather than cylindrical as can be seen for example in FIGS. 16 or 20. Furthermore, the closure head 5 is narrowed as a result of the support on the cone surface. It is, as it were, forced into the—top—cone surface. The membrane tabs are thus deflected vertically downwards, with the result that they gape open in the downward direction, in response to the slight internal pressure, and ensure good—possibly additional—ventilation of the container.

As regards the arrangement of the closure membrane 2 in the closure cap 1, it is also important that the interstices 17 between the connecting wall 4 and the closure head 5 are arranged above the through-passage opening 8. The closure head 5 is preferably also arranged, in its entirety, above the through-passage opening 8. A discharge opening taper dimension a, running from the through-passage opening 8 to the largest point of the widened region 9 still used by the connecting wall 4, is a multiple of the thickness of the connecting wall 4, preferably, for example, four times to ten times the thickness of the connecting wall 4.

Figure 3:
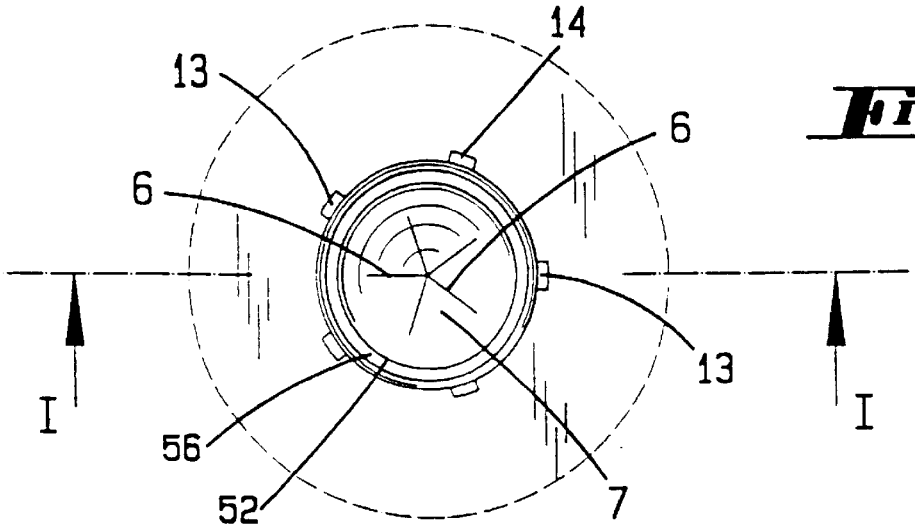
FIG. 3 shows an illustration of a plan view of the closure according to FIG. 1.
Figure 4:
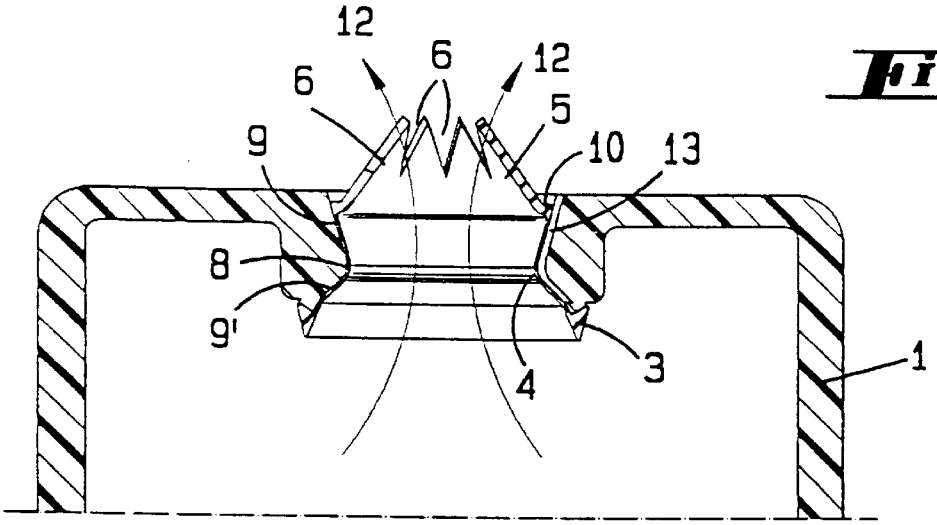
FIG. 4 shows the closure according to FIG. 1 in the discharge state.

It can be seen from the plan view according to FIG. 3 that ventilation grooves 13, 14, etc. are formed in the widened region 9, but also so as to pass through the through-passage opening 8. These grooves make it possible for air to be sucked into the container—possibly additionally—during sucking back, the retaining border 3 being lifted, at least locally, from its support on the closure cap 1, in the region which is indicated by the reference numeral 13. The action of air being sucked in can take place in addition to the above-mentioned ventilation as a result of top cone support and grooves which may be formed there.

Figure 5:
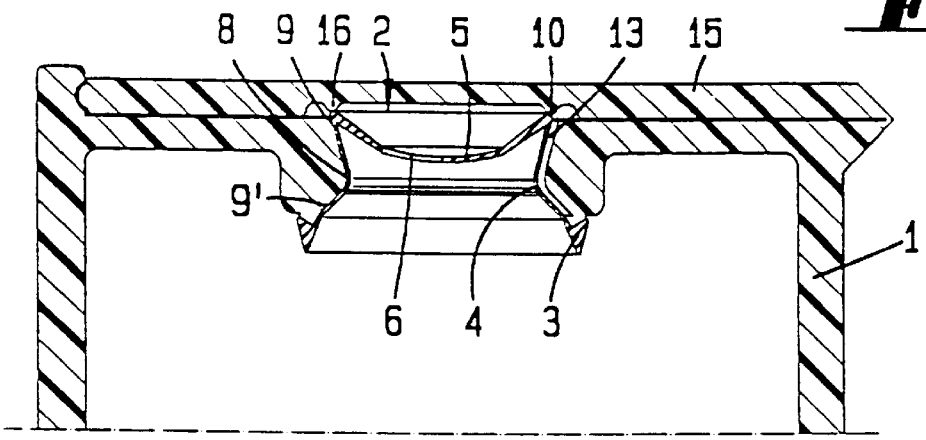
FIG. 5 shows an illustration of the closure according to FIG. 1 with a transportation safeguard.

The border bead 10 is important, in particular, for the purposes of a transportation safeguard, as is illustrated in FIG. 5. The transportation safeguard comprises a cover 15 which has a circular closure bead 16 formed on the underside. In the closed state, the closure bead 16 interacts with the border bead 10. This not only obstructs, to a considerable extent, the closure head 5 from moving into an open position according to FIG. 4, but rather the internal pressure, which could result in contents being discharged, has the effect of enhancing the pressure by which the border bead 10 is pressed against the closure head 15, and thus increasing the sealing action, since the pressure prevails directly on the inside, in the interstice 17, see FIG. 2. As a result of the concave design of the closure head 5 in the closed state, preferably achieved by the abovedescribed operation of turning the closure membrane 2 inside out after production, the curvature forces are enhanced by the internal pressure and the expansion obstructed by abutment against the border bead 10, with the result that the sealing action is even enhanced in the region of the abutting flanks of the slits in the closure head. The action of the closure membrane being forced into the cone allows the membrane base to be shaped convexly (to a pronounced extent). The closure head also forces the membrane into the cone surface to a pronounced extent. Consequently, a vertical opening force, which acts on the closure head from the interior of the container, for example, as a result of excessive internal pressure, achieves a deflection radially outwards and interception by the closure head or the cone wall. This results in opening of the membrane tabs being expressly blocked and the discharge of product being prevented. The cavity between the closure head and the closure membrane remains hygienically clean. The state of self-locking as a result of the cone support also continues, to a somewhat reduced extent, after opening of the closure head and thus prevents product from being discharged in the normal state of the container, in particular also when the relevant container provided with the closure is arranged upside down.

Figure 6:
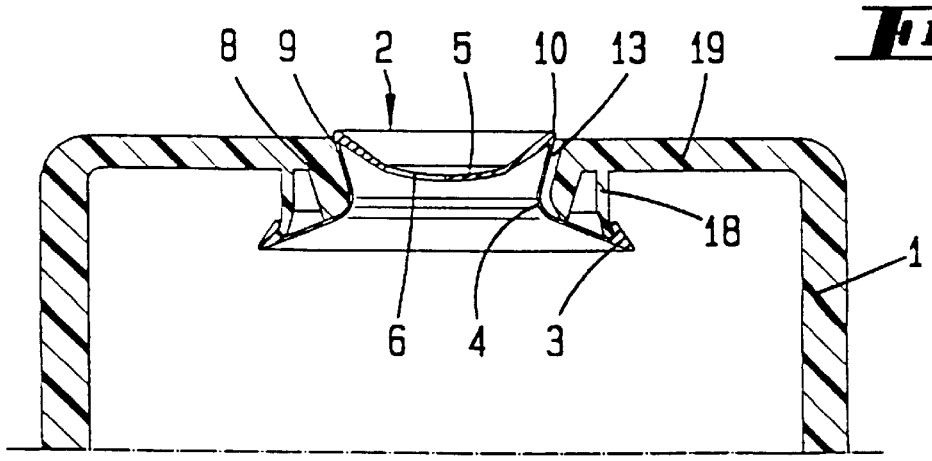
FIG. 6 shows a cross-sectional illustration through a closure cap with a closure membrane in a further embodiment.

In the embodiment according to FIG. 6, the closure cap is merely designed, on the inside, essentially with an outer widened region 9. The through-passage opening 8 constitutes the narrowest point of the widened region 9. In contrast to the embodiment of FIG. 1, where a further, inner widened region 9' adjoins the through-passage opening 8 in the opposite direction, the connecting wall 4 according to the exemplary embodiment of FIG. 5 is unsupported but, likewise widening conically, is drawn radially downwards beneath the through-passage opening 8, following a narrow region, which widens conically to a pronounced extent, in which it butts against the closure wall, and the retaining border 3 grips behind a separate retaining protrusion 18, which projects downwards from the top closure wall 19 of the closure cap 1. This retaining web 18 is closed all the way round in the manner of a cylinder.

Figure 7:
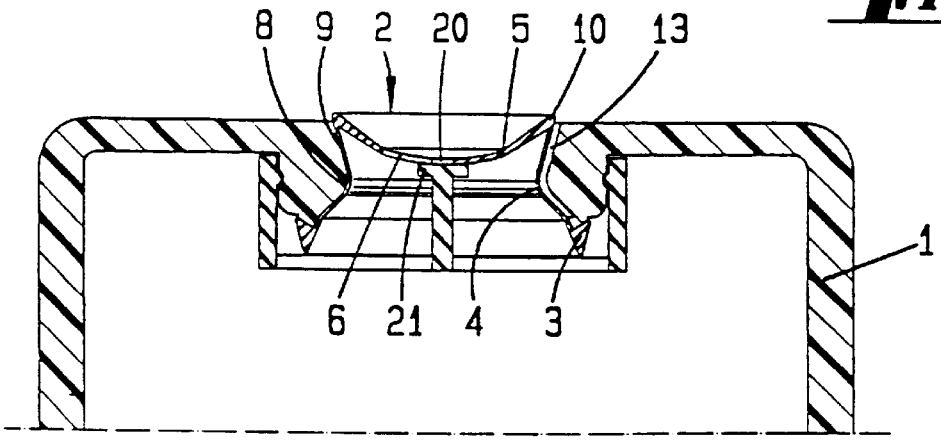
FIG. 7 shows an illustration according to FIG. 1, in which a supporting plate is provided.
Figure 8:
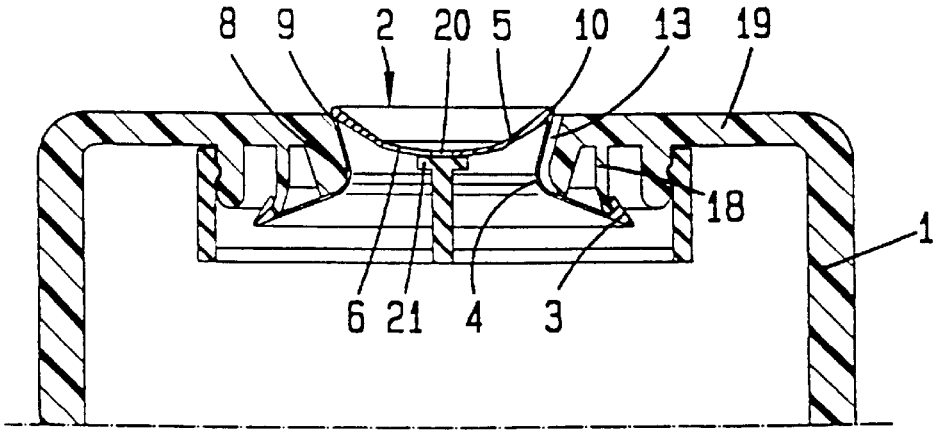
FIG. 8 shows an illustration according to FIG. 5, likewise with a supporting plate.

In the exemplary embodiments of FIGS. 7 and 8, the closure membrane 2 is designed with a central opening 20, which is permanently open. The opening 20 has a supporting plate 21 beneath its underside, this supporting plate being adapted at any rate to the diameter or the cross-section of the opening 20, but being larger than the opening. This type of closure membrane 2 once again permits considerably easier discharge of product from a container provided with such a closure. This may be advantageous, in particular, for adaptation to different viscosities. The opening 20 is sealed only in the closed position. In addition to the opening 20, radial slits may also be provided, as is explained in relation to FIG. 1. A central hole 20 in the closure head 5 is particularly useful for closure membranes or valves made of Thermoplastic Elastomer (TPE).

As a result of the special closure-membrane geometry which has been described, it is the case, in all of the exemplary embodiments illustrated, that in normal usage, during a dispensing operation, the position of the top border bead 10 remains virtually unchanged. Internal pressure causes the closure head 5 to extend, as it were, and then the membrane tabs are caused to gape open, as has been described above, and they release the path for the product. The elastic changes in the closure membrane, which are plain to see, prior to the actual discharge of product signal to a user that this discharge of product is imminent. This significantly enhances the handling and the use of such a closure and of such a closure membrane. It is also the case that the closure and the closure-membrane area remain clean after a relatively long period of use, because this expansion effect causes the point at which the product is discharged to go beyond the closure surface.

In a modification of the support illustrated in FIGS. 7 and 8, it may also be provided that the support is provided in the form of a supporting ring which merely obstructs the closure membrane from moving back, this action being triggered, for example, by sucking back, into the storage chamber. The supporting ring may be designed here with such a diameter that it supports the membrane outside the area of the slits 6, 7. However, this ring may also be configured such that it additionally fulfils a closure function with respect to a slit or a central opening, as has been explained above.

In all of the exemplary embodiments, the closure membrane consists of a flexible, easily deformable plastic material. The closure membrane can be moulded so as to be in the position in which it is used.

FIGS. 9 to 12 show a closure membrane 2 with a closure head 5 and a connecting wall 4. This example requires to be turned inside out as described in the following. Starting from a border edge 23, the closure head 5 tapers towards the centre, as seen in cross-section. An inner radius R1 is smaller than an outer radius R2, these two radii—alone—providing the geometry of the closure head 5. A formation or reinforcement ring 24 adjoins the connecting wall 4—at the top in FIG. 10. In the injection-moulded state of the closure membrane 2, which is illustrated in FIGS. 9 to 12, this reinforcement ring extends essentially inwards. Its upper side forms a supporting surface 25. This supporting surface runs approximately horizontally, i.e. essentially at right angles to the direction in which the connection wall 4 extends.

Furthermore, a fastening ring 26 is attached to the connection wall 4, in the region of the reinforcement ring 5 in the exemplary embodiment. The fastening ring 26 is basically comparable with the abovedescribed retaining ring 3. The fastening ring is attached to the connection wall at an attachment wall 27 which forms a lower part of the connection wall. The attachment wall 27 extends outwards with respect to the upper part of the connection wall 4. In the exemplary embodiment, the direction in which the attachment wall 27 extends is selected such that it encloses an acute angle beta with a vertical line V. In a further detail, the attachment wall 27 is also essentially Z-shaped in cross-section, the middle bar of the Z (this middle bar, here, nevertheless running in a rectilinear or vertical manner rather than obliquely) forming an intermediate wall 28 which extends essentially vertically. This is adjoined by a horizontal wall 29, which merges into the fastening ring 26.

Connection studs 30 are formed so as to be oriented downwards from the horizontal wall 29 or the fastening ring 26.

These connection studs 30 serve for positively locking assembly with an installation ring 31. The importance of the installation ring 31 is explained below.

Figure 12:
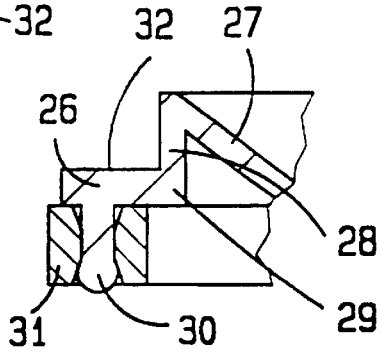
FIG. 12 shows an enlarged detail from the illustration according to FIG. 10, after assembly with the installation ring.

Whereas the closure membrane consists of a flexible silicone material or of an elastomeric plastic material, which is also comparatively flexible, the installation ring 31 consists of a normally hard plastic material. Since, as is illustrated in the exemplary embodiments, the horizontal wall 29 or fastening ring 26 has a top, essentially horizontally extending surface 32, advantageous sealing is provided in the installed state. The enlarged detail depicted in FIG. 12 shows the closure membrane 2 assembled with the installation ring 31.

In the exemplary embodiment, the attachment wall 27 is connected to the connecting wall 4 in the region where the reinforcement ring 24 adjoins. In order to reinforce the closure membrane 2 in this region, an outwardly projecting reinforcement protrusion 33 is also formed all the way round. In the cross-sectional illustration, this is shown as a bay-window-like protrusion.

Figure 9:
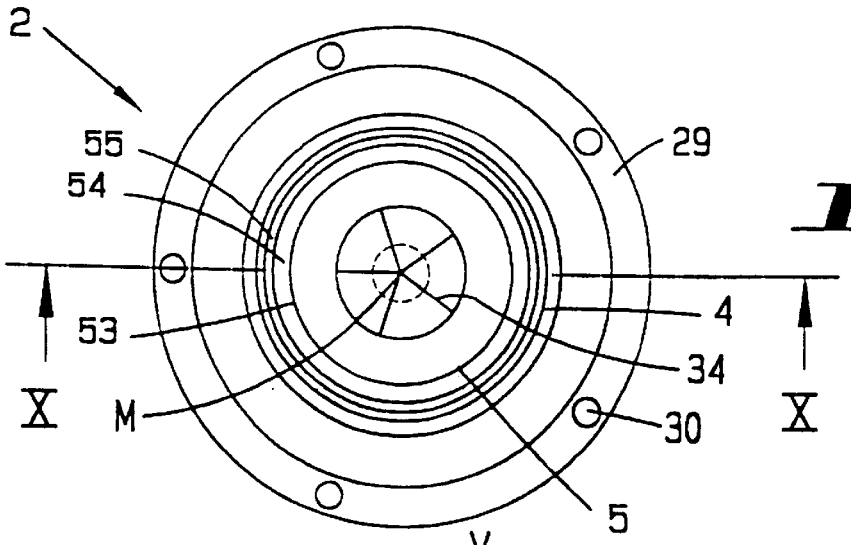
FIG. 9 shows a bottom view of a closure membrane.
Figure 11:
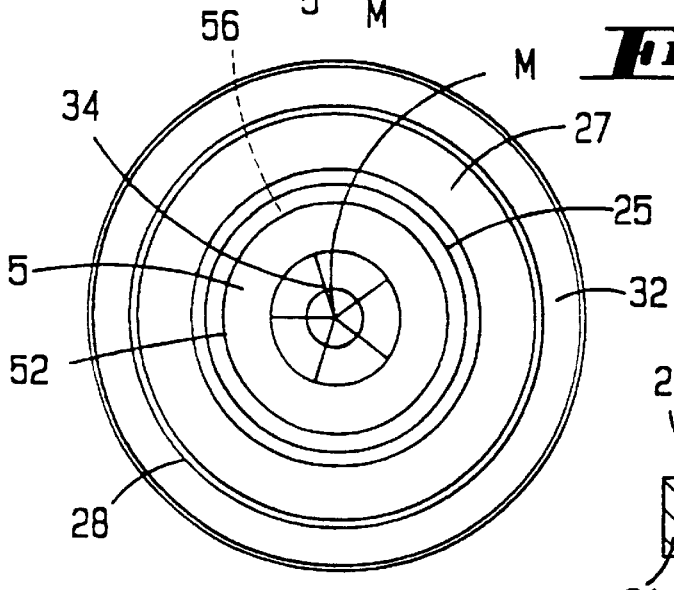
FIG. 11 shows a plan view of the embodiment according to FIGS. 9 and 10.

As can further be seen from FIGS. 9 and 11, the closure head 5 of the closure membrane 2 is designed with radial cuts 34, starting from a centre point M, which provide for use as a dispensing opening. In a further detail, it can also be seen that, assigned to the centre point M, there is a thinned section 5' in the region of the membrane tabs, which are produced as a result of the radial cuts. This is advantageous as regards the ventilation after a dispensing operation. The tips of the membrane tabs thus bend out even more easily. By contrast, the sealing function is not influenced to any considerable extent under slight internal pressure.

FIGS. 13 to 16 illustrate a first installation example of such a closure membrane 2. The thinned section 5' is not provided here or in any of the further exemplary embodiments. It can be seen that, during the dispensing operation (see FIGS. 14 and 15), the horizontal surface 25 of the reinforcement ring 24 comes into abutment against a mating surface 35 in the closure cap 1. As a result of the geometry of the closure membrane 2 which is illustrated or, as is preferably provided, with production of the closure membrane 2 with an injection-moulded state according to FIGS. 9 to 12 and inside-out installation according to FIGS. 13 to 16, the closure head 5, along with the connecting wall 4 which is situated beneath the closure head 5 in a goblet-like manner, lift vertically upwards, freeing the cone surface, i.e. the widened region 9, in the process. This lifting operation is essentially achieved by a change in angle between the attachment wall 27 and the intermediate wall 28. After the surface 25 comes into abutment against the surface 35, a further increase in the internal pressure causes the closure tabs to open out, this resulting in the closure membrane being in the open state according to FIG. 15.

Figure 16:
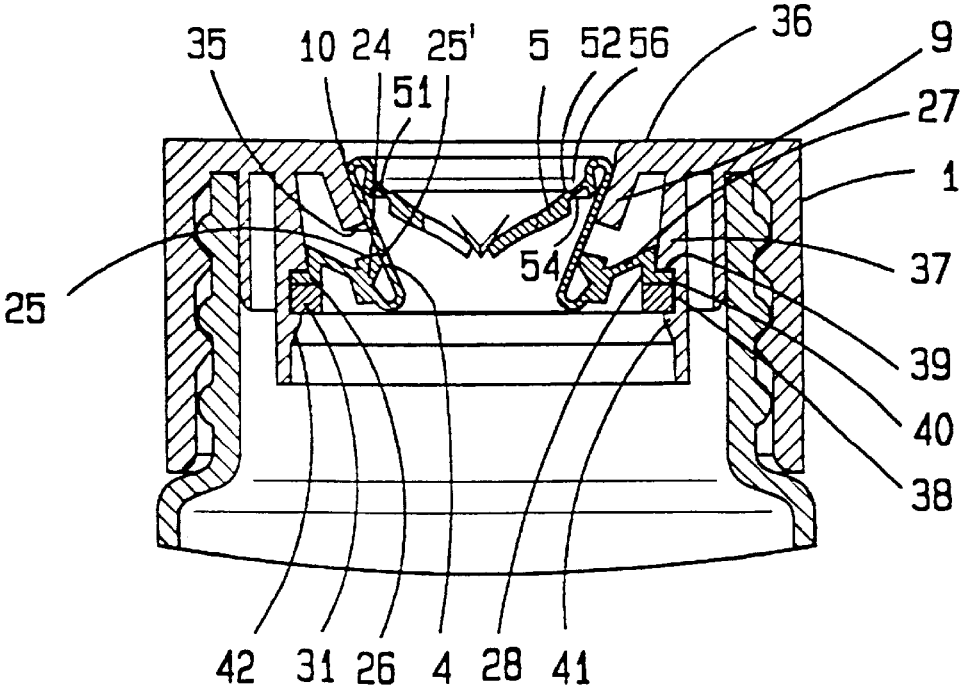
FIG. 16 shows the closure according to FIG. 13 after completion of a dispensing operation and during the sucking back of air.
Figure 17:
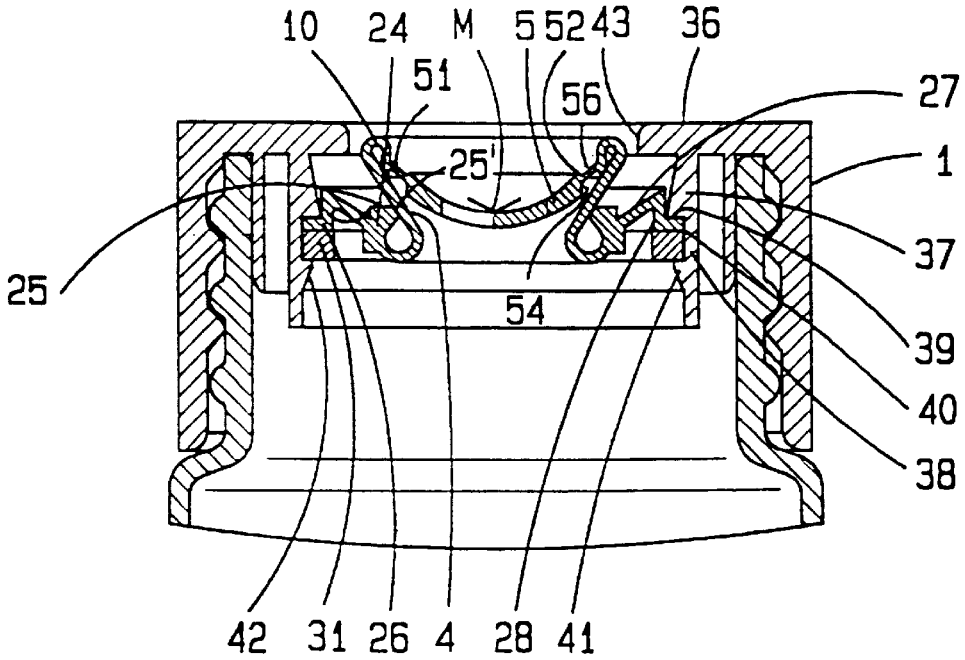
FIGS. 17 to 20 show illustrations corresponding to FIGS. 13 to 16, but for a further installation example.
Figure 18:
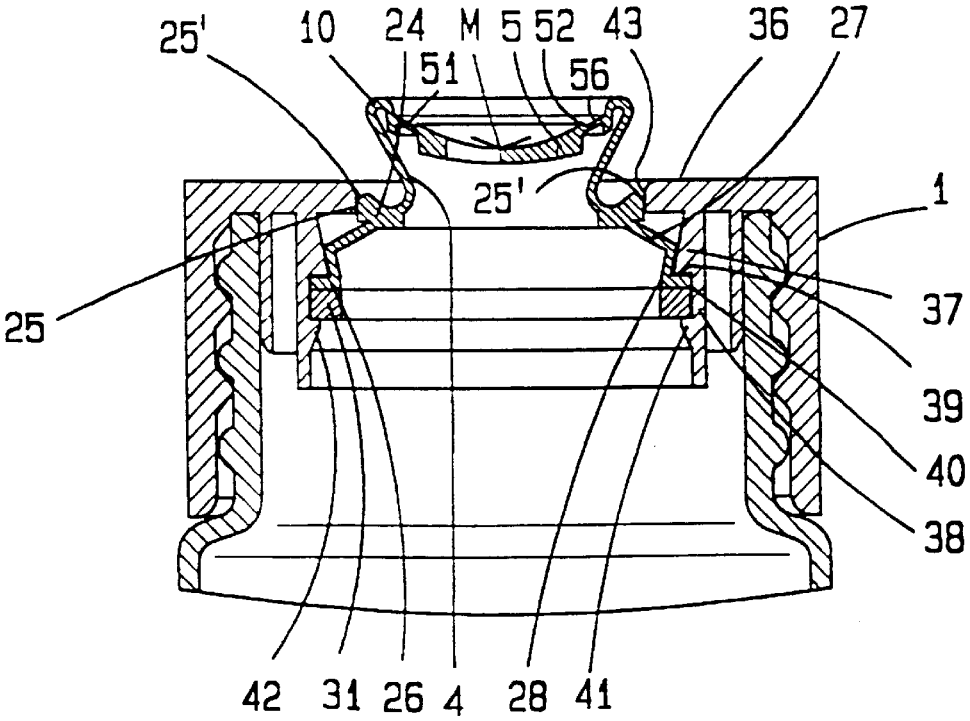
Figure 19:
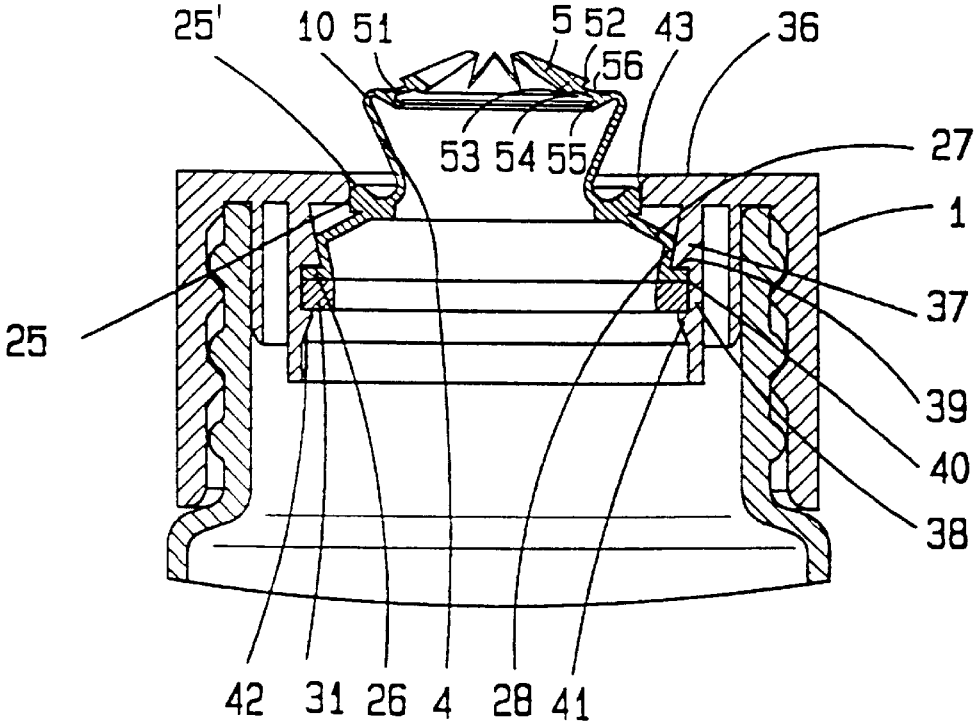

After completion of the dispensing operation, the closure membrane 2 is caused, by the negative pressure in the connected container, to move back, into the position according to FIG. 16. In this position the sub-region 55 contacts the inner surface of the connecting wall 4. In addition, the reinforcement ring 24 contacts the outer surface of the connecting wall 4. The negative pressure which continues to prevail causes the closure tabs to break out downwards, those forces which are produced as a result of said contacts and abutment of the closure head 5 against the connecting wall 4 and, furthermore, by the connecting wall 4 in the supporting wall 9 contributing to this action. Said sub-region 55 and/or the reinforcement ring 24 and/or the supporting wall 9 provide additional or alternative resistance against turning inside out of the closure head 5 during venting.

It can be seen that, in the region where the connecting wall 4 is connected to the closure head 5 the connecting wall 4 forms a border bead 10 as a result of the attachment, which is at the top in the closed state. This border bead 10 is also advantageous, in particular, as regards sealing for purposes of protection during transportation, as is also explained in more detail below.

As has already been mentioned, the closure cap 1 has a conical or funnel-like widened region 9. At the same time, this widened region 9 has on its underside, the free end surface, the abutment surface 35. Furthermore, starting from a top, essentially planar closure wall 36, the closure cap 1 has a cylindrically downwardly projecting retaining wall 37. The retaining wall 37 is integrally formed at a lateral distance, offset radially outwards, from the widened region 9.

A retaining recess 38 is formed in the cylindrical retaining wall 37, beneath the level of the end surface 35 in the exemplary embodiment. This retaining recess 38 has a top stop surface 39, an essentially vertically extending retaining wall 40 and a bottom retaining bead 41, which projects inwards with respect to the retaining wall 40 and has a run-on slope in the downward direction as the result of a widening in the radial direction.

The fastening ring 26 of the closure membrane 2 is clamped in this retaining recess 38, to be precise such that the top horizontal surface butts against the surface 39 of the retaining recess 38. The installation ring 31, consisting of conventional hard plastic material, is arranged on the underside of the foot area of the fastening ring of the closure membrane 2. As has already been explained above, the installation ring 31 may be pre-installed by connecting it to the closure membrane 2. The installation ring 31 is seated in the retaining recess 38, together with the fastening ring 26 of the closure membrane 2, such that the horizontal surface of the fastening membrane 2 is pushed upwards against the surface 39 of the retaining recess. This gives a clamping fit. This pressing action of the relatively flexible material of the closure membrane 2 advantageously provides sealing in this region at the same time. Furthermore, very cost-effective installation is possible. All that is required is for the closure membrane 2 with the pre-installed installation ring 31 to be positioned in the retaining wall 37 from beneath and then pressed into place. As a result of the run-on ramp 42, the closure membrane 2, with the ring, clips into the retaining recess and is fastened securely.

The abovedescribed reinforcement ring 24, which is also offset radially inwards with respect to the fastening ring 26 in the fastened state, as can be seen, reliably ensures that the closure membrane 2 cannot be sucked downwards during normal operation. Apart from the abutment of the closure membrane 2 in the widened region 9, the reinforcement ring 24 provides an annularly fixed constriction, through which the closure head cannot readily pass.

A further installation example is illustrated in FIGS. 17 to 20, and only the differences from the previous installation example will be described in this respect.

It can be seen that there is no widened region 9 in this installation example. Rather, the closure opening 43 is merely of the same size as the closure head. The closure membrane 2, or the bead 10 at any rate, is seated in the region of the closure opening 43, at a lateral distance from the latter, forming a peripheral gap in the process. At the same time, the closure wall of the closure opening 43 serves as an abutment surface for the surface 25 when the closure membrane 2 moves out during a dispensing operation, as can be seen from FIGS. 18 and 19. The fastening recess in the fastening flange is provided at a correspondingly higher level.

Otherwise, the same conditions as described above apply, although force assistance by the widened region is no longer provided. It is also important that, in the embodiment of FIGS. 13 to 16 and the embodiment of FIGS. 17 to 20, as well as the embodiment of FIGS. 21 to 26 described below, a surface 25' of the reinforcement ring 24 comes into abutment against the connecting wall 4 in the sucking-back state or ventilation state. Together with, as also occurs in practice, an abutment of the closure head 5 against the connecting wall 4 in this state, thus also against the surface 24' of the reinforcement ring 24 in this region, a lever action which assists the gaping-open action of the closure tabs is produced.

The embodiment according to FIGS. 21 to 25 provides a configuration which is comparable to FIGS. 13 to 16 as regards the support 9. Specifically, however, there is a change to the effect that the widened region 9 has individual tab-like elements 43. The interspaces 44 produced between the elements 43 (see also FIG. 26) are of importance. In the sucking-back state, the closure membrane 2 is positioned in these openings 44 and is deformed there slightly in a groove-like manner. This continues as far as the region of the centre point or of the separating slits, as a result of which the ventilation is assisted to a considerable extent once again.

Figure 24:
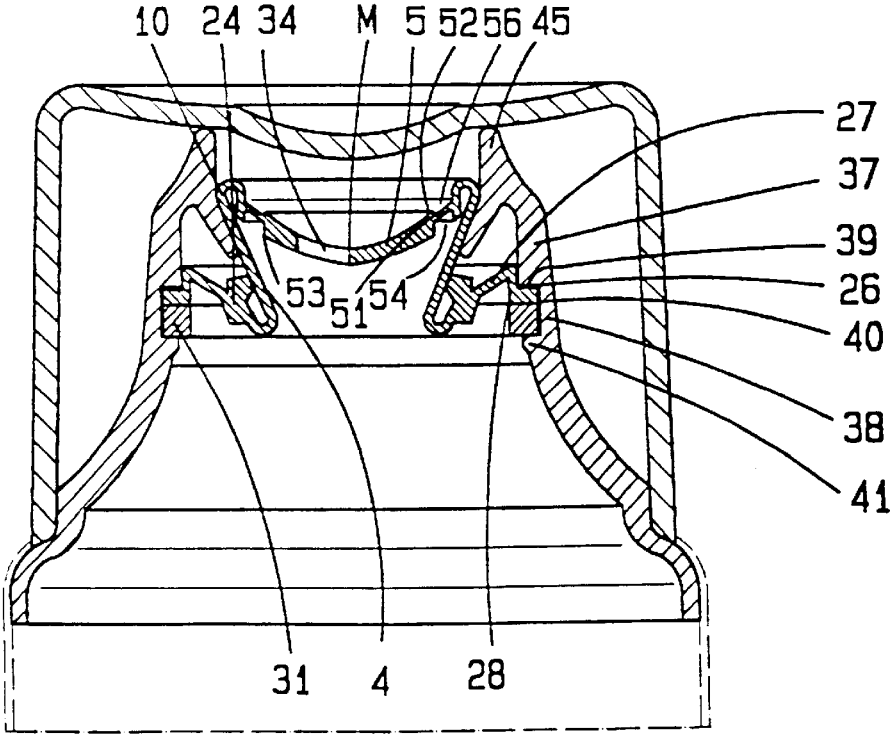
FIG. 24 shows a further installation example, in relation to a tube closure.

In the exemplary embodiment of FIG. 24, a tube closure is illustrated in cross-section. Comparable conditions apply here too, but with the difference that the region 9, which runs in an essentially conically opening manner, as described, is adjoined by a cylindrical wall 45 of approximately the same height, in relation to the vertical extent of the widened region 9. With a vertical displacement of the closure head 5 essentially parallel to itself (see, for example, movement of the closure head in FIGS. 17 and 18), the outer border of the closure head, here by way of the bead 10, butts against the inner surface of the cylindrical wall 45 and moves relative to this. This means, on the one hand, that, when the closure membrane moves out, something of a wiping-off or scraping-off action takes place along the inner surface of the cylindrical wall 45. When the closure membrane moves back, a wiping effect also takes place once again in this respect, as does a suction effect. In addition, a bowl-like configuration is provided, and any residual liquid may be collected (first of all) in this bowl. Since, with corresponding negative pressure, there is then sucking back into the container, residual emptying may thus also then be achieved.

Figure 25:
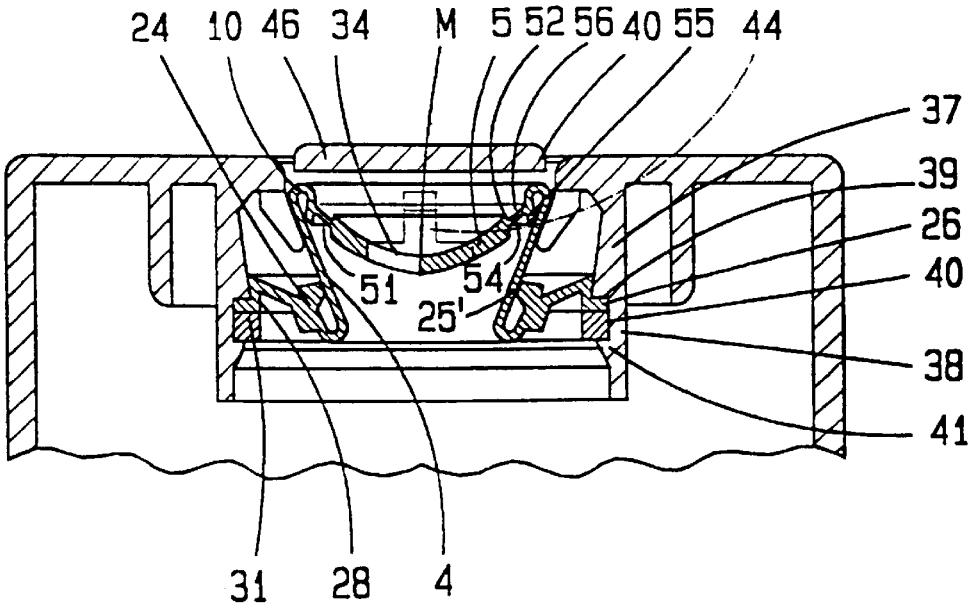
FIG. 25 shows an illustration according to FIGS. 21 to 23, but with a tamperproof seal.

Furthermore, a tamperproof seal 46 attached via tear-off webs is illustrated, in the closure opening, in FIG. 25.

Figure 26:
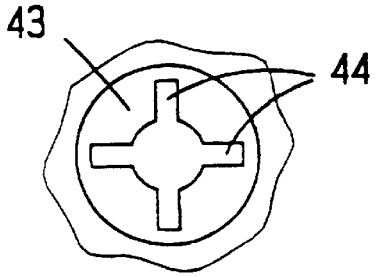
FIG. 26 shows a plan view of the closure in the region of the closure opening after the tamperproof seal and the closure membrane have been removed.

FIG. 26 shows a plan view of the closure according to FIG. 25, with the tamperproof seal 46 and closure membrane 2 removed.

It is possible to see the individual elements 43, which provide the closure membrane 2 with conical support comparable to the widened region 9. The abovementioned interspaces 44 are also shown.

Figure 27:
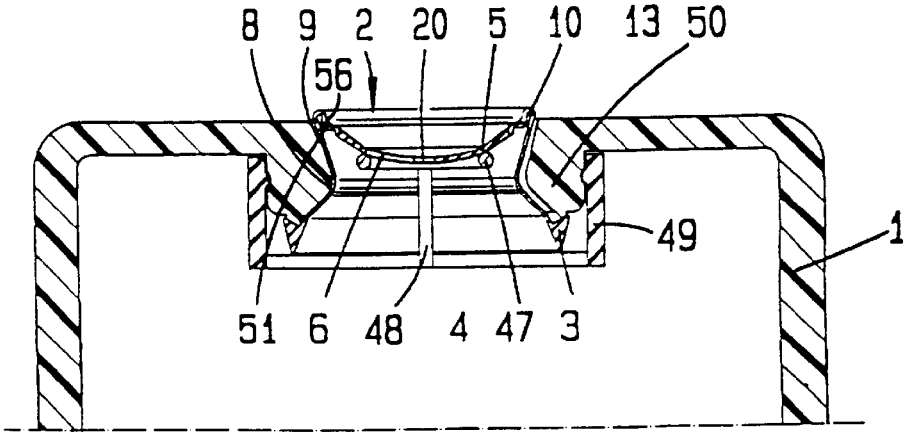
FIG. 27 shows a further embodiment.

A supporting ring 47 is illustrated in the embodiment of FIG. 27, this supporting ring supporting the closure head 5 of the closure membrane 2 at bottom in the installed state. The supporting ring 47 maybe connected, via one or more webs 48, to an insertion-ring body 49, which is clipped to the closure head or a downwardly projecting closure-head flange 50, which forms the widened region 9. The diameter of the supporting ring 47 is preferably made to suit the extent of the slits in the closure membrane. It is recommended for the diameter to be somewhat larger than the extent of the slits. This supporting ring 47 gives a similar effect, in particular during the sucking-back operation, as has already been described in conjunction with the other exemplary embodiments, in relation to the reinforcement ring: the result is a lever-like transmission of force by the internal pressure in the region of the closure tabs, with the result that the latter are caused to gape open more easily. In addition, this ring also secures the closure membrane 2 in the installed position separately and independently. Such a ring may also be used in all of the exemplary embodiments.

Furthermore, a separate proposal is that of moulding such a supporting ring integrally on the closure membrane by two-component injection moulding.

All the features disclosed are fundamental to the invention. The disclosure of the application thus also includes the disclosure of the associated/attached priority documents (copy of the prior application) in full, also for the purpose of incorporating features of these documents in claims of the present application.

As shown and described with reference to FIGS. 13 to 25, the closure head 5 is movable between a lower and an upper position.

As described above with particular reference to FIGS. 13 to 16, the lifting operation is essentially achieved by a change in angle between the attachment wall 27 and the intermediate wall 28. In further detail, the connecting wall comprises a lower part and a unitary upper part being arranged in such a way that an angle is formed between the outer surfaces of said lower part and said upper part. In the rest position said angle is smaller than in the dispensing state. When pressure is applied to the inner side of the closure membrane, the closure head 5 is lifted vertically upwards due to a tilting action between said lower part and said upper part of the connecting wall 4. At the same time said angle increases and the total height of said lower part and said upper part increases, too. Upon release of the pressure the closure head 5 and the connecting wall 4 automatically move back into the rest position due to the resiliency of the material of the closure membrane and due to this particular construction.

According to the present invention this lifting operation of the closure membrane can be achieved by providing only one lower part and one upper part unitarily forming the connecting wall 4. As preferred embodiments, additional features may be provided like the attachment wall 27, the intermediate wall 28, the reinforcement ring 24 and/or the flange 55. In a closure cap this closure membrane can also be used without any conical support.

What is claimed is:

1. Closure membrane (2) with a closure head (5) and a retaining border (3), the closure head (5) being connected to the retaining border (3) via a connecting wall (4), the entire arrangement being of essentially cup-shaped design and the closure head (5) preferably being of a thickness which increases outwards from the centre, characterised in that the connecting wall (4) is attached to the closure head (5) via a connecting web (51) which is of a lesser thickness than the connecting wall and the border region of the closure head (5), the connecting web having a thickness within the range 0.2 mm to 0.35 mm and in the rest position of the membrane projecting radially inwards from the connecting wall (4).

2. Closure membrane according to claim 1, characterized in that the connecting web (51) adjoins the closure head (5) approximately centrally, as seen in the vertical direction.

3. Closure membrane according to claim 1, characterized in that the connecting web (51) adjoins the closure head (5) eccentrically, as seen in the vertical direction.

4. Closure membrane according to claim 1 characterized in that the connecting wall (4) extends beyond the connecting web (51) such that the peripheral groove (54) is formed with a border edge of the closure head (5).

5. Closure membrane according to claim 1 characterized in that the connecting wall (4) and the connecting web (51) are connected to the closure head (5) so as to produce, in cross-section, two mutually opposite, peripheral grooves (54, 56) which are separated by the connecting web (51).

6. Closure membrane according to claim 1 characterized in that a free outer end of the closure membrane comprises a bead (10) the material of which can expand radially outwards in response to pressure being applied onto the inner surface of the closure membrane so as to stretch the closure head (5) open.

7. Closure according to claim 1 characterized in that a border bead (10) which preferably projects beyond the closure head (5) is formed in an outer region of the closure head (5).

8. Closure membrane according to claim 1 characterized in that the closure head (5) comprises a thinned section (5') which is preferably provided in the centre of the closure head (5).

9. Closure membrane according to claim 1 characterized by a flange (55) being provided at an inner surface of the connecting wall (4), wherein the flange preferably extends beyond the connecting web (51).

10. Closure membrane according to claim 1 characterized by a formation (24) being arranged on an outer surface of the connecting wall (4), which preferably projects from a lower part of the connecting wall.

11. Closure membrane according to claim 1 characterized in that the thickness of the connecting web (51) is 0.25 mm.

12. Closure membrane according to claim 1 characterized in that the connecting wall (4) is at least 50% thicker than the connecting web (51).

13. Closure membrane according to claim 1 characterized in that the connecting wall has a thickness within the range 0.3 mm to 0.6 mm.

14. Closure membrane according to claim 13, characterized in that the connecting wall has a thickness of 0.4 mm.

15. Closure membrane according to claim 1 characterized in that the thickness of the closure head is 2 to 4 times greater than the thickness of the connecting wall.

16. Closure membrane according to claim 1 characterized in that the closure head (5) comprises at least one slit (6, 7, 34), which preferably extends radially from the centre and/or at least one hole (20), which is preferably provided in the centre of the closure head (5).

17. Closure membrane according to claim 1 characterized in that a retaining border (3) is supported radially by the connecting wall (4).

18. Closure membrane according to claim 1 characterized in that in the non-actuated installed state, the closure head (5) has an essentially concave form as seen from the outside wherein preferably a radius (R1) of the outer surface is smaller than a radius (R2) of the inner surface.

19. Closure membrane according to claim 1 characterized in that the installed state is achieved by turning the closure membrane inside out after it has been produced by injection moulding.

20. Closure membrane according to claim 1 characterized in that, starting from a border-side attachment to the closure head, the connecting wall (4) continues into a constriction beneath the projection area of the closure head.

21. Closure membrane according to claim 1 characterized in that the connecting wall (4) adjoins the bottom of the closure head (5) in an essentially cylindrically extending manner.

22. Closure membrane according to claim 1 characterized in that the border side of the closure head (5) is of a greater thickness than the boundary wall, in that the boundary wall is attached to a top region of a border edge, as seen in cross-section, of the closure head, and in that the boundary wall grips over a bottom, free boundary region of the boundary edge of closure head.

23. Closure membrane according to claim 1 characterized in that, in the injection-moulded state, the connecting wall (4) runs essentially cylindrically.

24. Closure membrane according to claim 1 characterized in that the connecting wall (4) comprises a fastening ring (26) which is preferably attached to the reinforcement ring (24).

25. Closure membrane according to claim 24 characterized in that the fastening ring (26) is connected to the reinforcement ring (24) via an attachment wall (27) which, in cross-section, extends at an angle to the connecting wall (4).

26. Self-closing closure comprising a closure cap (1) with a closure opening (8, 9, 35, 43) and further comprising a closure membrane according to claim 1, wherein the closure membrane is arranged relatively to the closure opening in such a way that the closure head (5) is located within the closure opening and preferably the closure head (5) projects beyond the closure cap (1).

27. Self-closing closure according to claim 26 characterized in that the closure cap (1) comprises a cover (15, 46), which preferably has a circular closure bead (16) formed on the inner side, wherein the bead (10) of the closure membrane can be engaged by said cover (15).

28. Self-closing closure according to claim 26 characterized in that the closure cap (1) comprises a mating surface (35), wherein during the dispensing operation the reinforcement ring (25) of the closure membrane comes into engagement with the mating surface (35).

29. Self-closing closure according to claim 26 characterized by a through-passage opening (8) and a widened region (9) adjoining the through-passage opening (8) towards the outside, wherein the closure head (5) is arranged in the widened region (9), and the connecting wall (4) extends into the widened region (9), passing through the through-passage opening in the process.

30. Self-closing closure according to claim 26 characterized by a through-passage opening (8) and a cylindrical wall (45) adjoining the through-passage opening (8) towards the outside, an internal diameter of the cylindrical wall (45) corresponding approximately to an external diameter of the closure head (5), and the closure head (5), during a dispensing operation, being displaced vertically into the region of the cylindrical wall (45).

31. Self-closing closure according to claim 26 characterized in that the border bead (10) of the closure membrane is arranged in the area of the widened region (9).

32. Self-closing closure according to claim 26 characterized in that a widened region (9') directly adjoins the through-passage opening (8), beneath the latter.

33. Self-closing closure according to claim 26 characterized in that a widened region (9, 9') is of conical design.

34. Self-closing closure according to claim 26 characterized in that a groove-like depression which reaches as far as the through-passage opening (8) is formed in the widened region (9,9').

* * * * *

UNITED STATES PATENT AND TRADEMARK OFFICE

CERTIFICATE OF CORRECTION

PATENT NO. : 6,213,355 B1
DATED : April 10, 2001
INVENTOR(S) : Sigurd Schwanenberg It is certified that error appears in the above-identified patent and that said Letters Patent is hereby corrected as shown below:

Column 2,
Line 43, after “membrane” insert -- - --;

Column 3,
Line 38, delete “state” and insert -- position --;

Column 4,
Line 31, delete “head” and insert -- cover --;

Column 7,
Lines 54 and 66, delete “head” and insert -- cover --;

Column 8,
Lines 5, 8 and 11, delete “head” and insert -- cover --;

Column 9,
Line 26, delete “5” and insert -- 24 --;

Column 12,
Line 36, delete “maybe” and insert -- may be --.

Signed and Sealed this

Twenty-seventh Day of January, 2004

JON W. DUDAS
*Acting Director of the United States Patent and Trademark Office*